US007384718B2

(12) United States Patent
Wu et al.

(10) Patent No.: US 7,384,718 B2
(45) Date of Patent: Jun. 10, 2008

(54) CHARGE GENERATING COMPOSITION AND IMAGING MEMBER

(75) Inventors: Jin Wu, Webster, NY (US); John J. Wilbert, Macedon, NY (US); Linda L. Ferrarese, Rochester, NY (US); Liang-bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 242 days.

(21) Appl. No.: 11/213,973

(22) Filed: Aug. 30, 2005

(65) Prior Publication Data

US 2007/0048638 A1 Mar. 1, 2007

(51) Int. Cl.
*G03G 5/05* (2006.01)

(52) U.S. Cl. ..... 430/96; 430/59.4; 399/159

(58) Field of Classification Search ..... 430/59.4, 430/96; 399/159
See application file for complete search history.

(56) References Cited

U.S. PATENT DOCUMENTS 3,121,006 A 2/1964 Middleton et al.
3,278,513 A 10/1966 Jahrstorfer et al.
4,265,990 A 5/1981 Stolka et al.
4,286,033 A 8/1981 Neyhart et al.
4,291,110 A 9/1981 Lee
4,338,387 A 7/1982 Hewitt
5,204,200 A * 4/1993 Kobata et al. ..... 430/59.4
5,324,615 A * 6/1994 Stegbauer et al. ..... 430/132
5,418,107 A * 5/1995 Nealey et al. ..... 430/132

OTHER PUBLICATIONS

Diamond, "Handbook of Imaging Materials," Marcel Dekker Inc, NY, NY. 1991.*

* cited by examiner

*Primary Examiner*—Christopher RoDee
*Assistant Examiner*—Peter L Vajda
(74) *Attorney, Agent, or Firm*—Oliff & Berridge, PLC

(57) ABSTRACT

A composition that finds particular utility in forming a charge generating layer of an imaging member includes at least one charge generating material, at least one polymer binder and at least one oxidized polyolefin polymer or copolymer. The oxidized polyolefin is able to impart a thixotropic rheology to the composition, and also is able to act as an anti-settling and anti-sagging agent in the composition.

19 Claims, No Drawings

CHARGE GENERATING COMPOSITION AND IMAGING MEMBER

TECHNICAL FIELD

Described herein is a charge generating composition, for example for use in forming a charge generating layer of an imaging member such as a photosensitive or photoconductive imaging member.

BACKGROUND

In the art of xerography and/or electrophotography, an imaging member is imaged by first uniformly electrostatically charging the imaging member. The imaging member is then exposed to a pattern of activating radiation, for example light, which selectively dissipates the charge in the illuminated areas of the imaging member while leaving behind an electrostatic latent image in the non-illuminated areas. This electrostatic latent image may then be developed to form a visible image by depositing finely divided toner particles, for example from a developer composition, on the surface of the imaging member. The resulting visible toner image can be transferred to a suitable image receiving substrate such as paper. This imaging process may be repeated many times with reusable photosensitive members.

Typical imaging members (for example, photoreceptors) comprise a photoconductive layer comprising a single layer or composite layers. One type of composite photoconductive layer is illustrated, for example, in U.S. Pat. No. 4,265,990, which describes a photosensitive member having at least two electrically operative layers. The first layer comprises a photogenerating layer, which is capable of photogenerating holes and injecting the photogenerated holes into the second layer, which comprises a contiguous charge transport layer. Generally, where the two electrically operative layers are supported on a conductive layer, the photogenerating layer is sandwiched between the contiguous charge transport layer and the supporting conductive layer, and the outer surface of the charge transport layer is normally charged with a uniform electrostatic charge.

Layered imaging members have been described in numerous U.S. patents, such as U.S. Pat. No. 4,265,990, the disclosure of which is totally incorporated herein by reference, wherein there is illustrated an imaging member comprised of a photogenerating layer and an arylamine hole transport layer. Examples of photogenerating layer components include trigonal selenium, metal phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

Although excellent toner images may be obtained with multilayered belt photoreceptors, it has been found that as more advanced, higher speed electrophotographic copiers, duplicators and printers continue to be developed; there is a greater demand on copy quality. A delicate balance in charging image and bias potentials, and characteristics of toner/developer, must be maintained. This places additional constraints on the quality of photoreceptor manufacturing. In certain combinations of materials for photoreceptors or in certain production batches of photoreceptor materials, localized microdefects (for example, of sizes varying from about 50 to about 200 microns) may occur. These microdefect sites appear as print defects in the final imaged copy. In charged area development, where the charged areas are printed as dark areas, the microdefect sites may print out as white spots. These microdefects are called microwhite spots. In discharged area development systems, where the exposed area (discharged area) is printed as dark areas, these microdefect sites may print out as dark spots in a white background. All of these microdefects that exhibit inordinately large dark decay are referred to as charge deficient spots (CDS). Since the microdefect sites are fixed in the photoreceptor, the spots may be registered in every cycle of the imaging member.

Charge generating compositions may be comprised of charge generating pigment dispersed in a polymer binder. However, such formulations may exhibit dispersion settling and aggregation of pigments. This may adversely result in charge deficient spots and other printing defects.

A stable charge generating composition, for example that may exhibit non-Newtonian, thixotropic rheology, and substantially free of aggregation of the charge generating pigments therein, is desired. Also desired is a charge generating composition that may be used in forming an imaging member exhibiting excellent quality, for example with substantial elimination of charge deficient spots, and capable of producing high quality images.

SUMMARY

In embodiments, described is a composition comprising at least one charge generating material, at least one polymer binder and at least one oxidized polyolefin polymer or copolymer. The composition has particular utility in forming a charge generating section or layer of an imaging member.

In further embodiments, described is an imaging member including a charge generating section therein, wherein the charge generating section comprises at least one charge generating material, at least one polymer binder and at least one oxidized polyolefin polymer or copolymer.

In still further embodiments, described is an imaging member comprising a substrate, a charge generating layer and a charge transport layer, wherein the charge generating layer comprises at least one charge generating material, at least one polymer binder and at least one oxidized polyolefin polymer or copolymer.

Image forming devices including the imaging member therein are also described.

EMBODIMENTS

The present disclosure relates generally to a composition, for example for use in forming a charge generating layer of an imaging member such as a photosensitive or photoconductive imaging member. The charge generating composition comprises at least one charge generating material, at least one polymer binder and at least one oxidized polyolefin polymer or copolymer.

As the at least one charge generating material, any charge generating material, including known charge generating materials, may be used alone or in any suitable combination. In embodiments, a charge generating material refers to a material that is capable of generating electrons and holes when subjected to radiation such as light.

As examples of charge generating materials suitable for use herein, mention may be made of metal free phthalocyanines, metal phthalocyanines such as hydroxy gallium phthalocyanine, alkoxy gallium phthalocyanine, chloro gallium phthalocyanine, chloro indium phthalocyanine, titanyl phthalocyanine, vanadyl phthalocyanine, copper phthalocyanine and the like, perylenes such as benzimidazole perylene, bisazos, perinones, quinacridones, anthanthrones, pyranthrones, indogoides, polycyclic quinones, selenium and selenium alloys, azo pigments, squaraines, mixtures thereof and the like. In embodiments, the charge generating material may include hydroxy gallium phthalocyanine, alkoxy gallium phthalocyanine, chloro gallium phthalocyanine and titanyl phthalocyanine.

In embodiments, the charge generating material is selected to have a photosensitivity of, for example, about 400 nm to about 900 nm, such as about 500 nm to about 850 nm. Photosensitivity refers to a material's response to radiation, for example light. The photosensitive material generates charges in the presence of light.

The charge generating material for use in embodiments is in particle form, for example as a pigment, and may have a size of, for example, less than about 5 μm, for example from about 0.001 μm to about 5 μm, such as from about 0.005 μm to about 1 μm or from about 0.005 μm to about 0.6 μm or from about 0.01 μm to about 0.1 μm. Further, in embodiments, the charge generating particles are substantially free of large agglomerations, for example, above 1 μm, that is, substantially free of particles that have formed a physically and/or chemically adhered mass with adjoining particles.

As the at least one polymer binder for the composition, any suitable film forming binder may be used. Examples of suitable binders for the charge generating materials include thermoplastic and thermosetting resins such as polycarbonates, polyesters including polyethylene terephthalate, polyurethanes, polystyrenes, polybutadienes, polysulfones, polyarylethers, polyarylsulfones, polyethersulfones, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinyl chlorides, polyvinyl alcohols, poly-N-vinylpyrrolidinones, vinyl chloride and vinyl acetate copolymers, including such copolymers with maleic acid and/or anhydride, acrylate copolymers, alkyd resins, cellulosic film formers, polyamideimides, styrene-butadiene copolymers, vinylidene chloride-vinyl chloride copolymers, vinyl acetate-vinylidene chloride copolymers, styrene-alkyd resins, polyvinyl carbazoles, any mixtures thereof and the like. The polymers may be block, random or alternating copolymers. In embodiments, the polymer binder may include a vinyl chloride-vinyl acetate-maleic acid copolymer, for example such as commercially available as VMCH from Union Carbide.

The charge generating material may be present in the polymer binder in various amounts, generally, however, from about 3% to about 90% by weight of the charge generating material is dispersed in about 10% to about 97% by weight of the polymer binder on a solids basis, for example from about 25% to about 80% by weight of the charge generating material is dispersed in about 20% to about 75% by weight of the binder.

The oxidized polyolefin may be one or more polyolefin polymers or copolymers. In embodiments, polyolefin refers to polymers and copolymers that are composed of, for example, at least about 55% up to 100% olefin monomers. In embodiments, polyolefins having a repeating unit of from 2 to about 15 carbon atoms in length may be used. As example polyolefins, mention may be made of homopolymers of polyethylene, polypropylene, polybutylene and the like, copolymers of olefin monomers such as ethylene, propylene, butylene and the like, and copolymers of olefin monomers with additional monomeric components, for example including vinyl acetate, maleic anhydride, (meth) acrylic acid, (meth)acrylate, (meth)acrylamide copolymers and the like.

In embodiments, the oxidized polyolefin may be utilized with other materials, for example with castor wax, amide wax, polymerized Linseed oil, surface active agents and the like, and mixtures thereof. The castor wax may be obtained by hydrogenating castor oil. The amide wax may be obtained by reacting vegetable oil fatty acids with amines. The surface active agents may include dimer acid esters and amine salts of sulfates.

In embodiments, the oxidized polyolefin is a polyethylene or polypropylene homopolymer or copolymer having a weight average molecular weight of from about 1,000 to about 1,000,000, such as about 10,000 to about 500,000, and the polyethylene or polypropylene homopolymer or copolymer being composed of from about 60 mol % to about 100 mol % of the polymer, such as about 80 mol % to about 100 mol % of the polymer, of the olefin unit(s).

In embodiments, the oxidized polyolefin may include some polar groups incorporated by oxidation of the polyolefin moiety. As a result, the oxidation degree may be defined, for example, by using the acid number in the unit of mg KOH/g from the ASTM D-1386 standardized test. The acid number of the oxidized polyolefin may be from, for example, about 0.1 to about 1,000 mg KOH/g, or from about 1 to about 100 mg KOH/g.

The oxidized polyolefin may be obtained commercially. For example, suitable oxidized polyethylene materials are available under the name DISPARLON, for example DISPARLON 4200-10 (oxidized polyethylene in xylene), DISPARLON 4200-20 (oxidized polyethylene in xylene), DISPARLON 4401-25M (oxidized polyethylene in petroleum naphtha), DISPARLON F-9010 (oxidized polyethylene with polyamide in xylene) or DISPARLON NS-30 (oxidized polyethylene with polyamide in xylene), from Kusumoto Chemicals. Other suitable oxidized polyethylene materials are available under the name A-C, for example A-C 307 (acid number~7 mg KOH/g), 316 (acid number~16 mg KOH/g), 325 (acid number~25 mg KOH/g), 330 (acid number~30 mg KOH/g), 395 (acid number~41 mg KOH/g), from Honeywell. Suitable oxidized polyethylene copolymer materials are available under the name A-C, for example A-C 645P (acid number~13 mg KOH/g), an oxidized ethylene-vinyl acetate copolymer, from Honeywell. The oxidized polyethylene may also be obtained by oxidizing a suitable starting polyethylene by any suitable oxidizing method. See, for example, U.S. Pat. No. 3,278,513, incorporated herein by reference in its entirety.

The oxidized polyolefin may be added into the composition without solvent or together in a substantially inert solvent, for example xylene as mentioned above, tetrahydrofuran, and the like. Any other suitable solvents may also be used. As but two possible methods for adding the oxidized polyolefin to the charge generating composition, mention may be made of (1) preparing a dispersion of the charge generating material in a polymer binder, and then adding the oxidized polyolefin into the dispersion, and (2) preparing a dispersion of the charge generating material, a polymer binder and oxidized polyolefin in one pot.

The oxidized polyolefin is added to the composition in an amount of from about 0.1% to about 30% by weight, for example from about 0.5% to about 20% by weight, such as from about 1% to about 10% by weight, of the composition on a solid basis.

The oxidized polyolefin may impart several desirable characteristics when included in a charge generating composition. For example, inclusion of the oxidized polyolefin can impart a non-Newtonian, for example a thixotropic or shear thinning, rheology to the composition. This may be desirable as it is generally the case that the composition undergoes stirring to ensure substantially uniform dispersion of the charge generating material in the binder, and the shear thinning at higher shear rates reduces the compositions viscosity so as to more readily achieve a substantially uniform dispersion. A further advantage of such rheology is that upon coating of the composition, the material increases in viscosity upon removal of the shearing conditions, thereby assisting in the fixing of the uniform dispersion in the formed coating. The oxidized polyolefin does not result in any substantial agglomeration of the charge generating material, thereby resulting in a composition substantially free of agglomerations and that is thus able to achieve a charge generating layer of high quality and a reduced tendency to generate charge deficient spots in an imaging member. The oxidized polyolefin may also act as an anti-sagging and anti-settling agent in the composition, again assisting in the coating formed from the composition having substantially uniform properties.

The presence of the oxidized polyolefin achieves a charge generating composition that is able to exhibit acceptable electrical performance when formed into a charge generating layer of an imaging member. Thus, the inclusion of the oxidized polyolefin does not appear to adversely affect the electrical performance properties of the charge generating material to an unacceptable extent.

Any other suitable or desired additives may be included within the charge generating composition.

Any suitable solvent may be utilized to dissolve and/or disperse the material in the composition. As suitable solvents, mention may be made of n-butyl acetate, methyl ethyl ketone, methyl isobutyl ketone, cyclohexanone, tetrahydrofuran, toluene, methylene chloride, monochlorobenzene, xylene and the like.

Coating dispersions of the composition for the charge generating section of an imaging member may be formed by any suitable technique using, for example, attritors, ball mills, Dynomills, paint shakers, homogenizers, microfluidizers and the like. Any suitable technique may be utilized to mix and thereafter apply the charge generating section composition. Typical application techniques include spraying, dip coating, roll coating, wire wound rod coating, and the like. Drying of the deposited coating may be effected by any suitable conventional technique such as oven drying, infrared radiation drying, air drying and the like. Drying is determined to be sufficient when the deposited film is no longer wet (not tacky to the touch). In embodiments, dip coating may be used to apply the composition to the imaging member.

The charge generating section of the imaging member that is comprised of the at least one charge generating material, the at least one polymer binder and the at least one oxidized polyolefin may be made to have a thickness of from about 0.05 μm to about 30 μm, for example from 0.1 μm to about 10 μm such as from about 0.1 μm to about 5 μm, although the thickness can be outside these ranges. The charge generating section thickness is related to the relative amounts of charge generating material and binder, with the charge generating material often being present in amounts of from about 5 to about 100 percent by weight. Higher binder content compositions generally require thicker layers for photogeneration. Generally, it is desirable to provide this layer in a thickness sufficient to absorb about 90 percent or more of the incident radiation that is directed upon it in the imagewise or printing exposure step. The maximum thickness of this layer is dependent primarily upon factors such as mechanical considerations, the specific photogenerating compound selected, the thicknesses of the other layers, and whether a flexible photoconductive imaging member is desired.

The charge generating section of the imaging member is a single layer in embodiments, although multiple layers may also be formed. A single layer may be formed by repeated applications of the composition.

The imaging member incorporating the charge generating section derived from the charge generating composition is, in embodiments, a multilayered photoreceptor that includes, for example, a substrate, an optional conductive layer, an optional undercoat (hole blocking) layer, one or more optional adhesive layers, the charge generating layer, a charge transport layer, an optional overcoat layer, and, particularly in some flexible belt embodiments, an anticurl backing layer. The imaging members may have any suitable form, for example including plates, drums, flexible belts and the like.

In embodiments, the imaging member is a flexible belt. Flexible imaging member belts may be fabricated by depositing the various layers onto long webs that are thereafter cut into sheets. The opposite ends of each sheet are overlapped and welded together to form an imaging member belt, for example by ultrasonic welding.

Additional layers of the imaging members such as photoconductors, photoreceptors and the like, for example that may be used in electrophotographic or xerographic imaging processes, will now be described.

Illustrative examples of substrate layers selected for the photoconductive imaging members, and which substrates may be known substrates and which can be opaque or substantially transparent, comprise a layer of insulating material including inorganic or organic polymeric materials, such as MYLAR®, a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example, a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on a number of factors, including the characteristics desired and economical considerations, thus this layer may be of substantial thickness, for example over 3,000 microns, such as from about 3,000 to about 7,000 microns, or of minimum thickness, such as at least about 10 microns, providing there are no significant adverse effects on the member. In embodiments, the thickness of this layer is from about 75 microns to about 300 microns.

If a conductive layer is used, it is positioned over the substrate. The terms "over" and "under" in embodiments should be understood as not being limited to instances where the specified layers are contiguous. Rather, the terms refer to relative placement of the specified layers and encompass the inclusion of unspecified intermediate layers between the specified layers.

Suitable materials for the conductive layer may include aluminum, zirconium, niobium, tantalum, vanadium, hafnium, titanium, nickel, stainless steel, chromium, tungsten, molybdenum, copper, and the like, and mixtures and alloys thereof.

The thickness of the conductive layer may be from about 20 angstroms to about 750 angstroms, such as from about 50 angstroms to about 200 angstroms, for a suitable combination of electrical conductivity, flexibility, and light transmission. However, the conductive layer can, if desired, be opaque.

The conductive layer can be applied by known coating techniques, such as solution coating, vapor deposition, and sputtering. In embodiments, an electrically conductive layer is applied by vacuum deposition. Other suitable methods can also be used.

If an undercoat or hole blocking layer is employed, it may be positioned over the substrate, but under the charge generating layer. The undercoat layer is at times referred to as a hole blocking layer in the art. Any suitable blocking layer capable of forming an electrical barrier to holes between the adjacent photoconductive layer and the underlying conductive layer may be utilized. Blocking layers are known and are disclosed in, for example, U.S. Pat. Nos. 4,286,033, 4,291,110 and 4,338,387, the entire disclosures of each being incorporated herein by reference.

Suitable hole blocking layers for use herein include polymers such as polyvinylbutyrals, epoxy resins, polyesters, polysiloxanes, polyamides, polyurethanes, phenolics and the like, nitrogen-containing siloxanes or nitrogen-containing titanium compounds, such as trimethoxysilyl propyl ethylene diamine, N-beta (aminoethyl) gamma-aminopropyl trimethoxy silane, isopropyl 4-aminobenzene sulfonyl titanate, di(dodecylbenezene sulfonyl) titanate, isopropyl di(4-aminobenzoyl) isostearoyl titanate, isopropyl tri(N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, as disclosed in U.S. Pat. No. 4,338,387, U.S. Pat. No. 4,286,033 and U.S. Pat. No. 4,291,110. Further, in embodiments, the hole blocking layer may contain a metal oxide like titanium, chromium, zinc, tin and the like, dispersed in the polymer matrix, for example phenolic polymers.

The hole blocking layer may be applied as a coating by any suitable technique such as spraying, die coating, dip coating, draw bar coating, gravure coating, silk screening, air knife coating, reverse roll coating, vacuum deposition, chemical treatment and the like. For convenience in obtaining layers, the hole blocking layers may be applied in the form of a dilute solution, with the solvent being removed after deposition of the coating by techniques such as by vacuum, heating and the like. Drying of the deposited coating may be achieved by any suitable technique such as oven drying, infrared radiation drying, air drying and the like.

The blocking layer may be continuous and have a thickness of from about 0.01 μm to about 10 μm, such as from about 0.01 μm to about 8 μm, as greater thicknesses may lead to undesirably high residual voltage.

In fabricating an imaging member, a charge generating layer is deposited and a charge transport layer may be deposited onto the substrate surface either in a laminate type configuration where the charge generating layer and charge transport layer are in different layers or in a single layer configuration where the charge generating layer and charge transport layer are in the same layer along with a binder resin. In embodiments, the charge generating layer is applied prior to the charge transport layer.

The charge generating layer is positioned over the hole blocking layer. If a hole blocking layer is not used, the charge generating layer is positioned over the substrate.

The charge transport layer may comprise a charge transporting molecule, for example a small molecule, dissolved or molecularly dispersed in a film forming polymer binder. In embodiments, a small molecule refers to a material such as a monomer that allows the free charge photogenerated in the charge generating layer to be transported across the transport layer. The active charge transport layer thus may comprise any suitable activating compound useful as an additive dispersed in electrically inactive polymeric materials, making these materials electrically active. These compounds may be added to polymeric materials that are incapable of supporting the injection of photogenerated holes from the generation material and incapable of allowing the transport of these holes therethrough. This will convert the electrically inactive polymeric material to a material capable of supporting the direction of photogenerated holes from the generation material and capable of allowing the transport of these holes through the active layer in order to discharge the surface charge on the active layer.

The charge transport layer may comprise from about 25 percent to about 75 percent by weight of at least one charge transporting molecule and about 75 percent to about 25 percent by weight of a polymeric film forming binder resin in which the charge transporting molecule is soluble.

Any suitable charge transporting or electrically active molecule may be employed in the charge transport layer. Typical charge transporting molecules may include, for example, pyrene, carbazole, hydrazone, oxazole, oxadiazole, pyrazoline, arylamine, arylmethane, benzidine, thiazole, stilbene and butadiene compounds; pyrazolines such as 1-phenyl-3-(4'-diethylaminostyryl)-5-(4'-diethylamino phenyl)pyrazoline; aryl amines such as N,N'-diphenyl-N,N'-bis (3-methylphenyl)-(1,1'-biphenyl)-4,4'-diamine; hydrazones such as N-phenyl-N-methyl-3-(9-ethyl)carbazyl hydrazone and 4-diethyl amino benzaldehyde-1,2-diphenyl hydrazone; oxadiazoles such as 2,5-bis (4-N,N'-diethylaminophenyl)-1,2,4-oxadiazole; poly-N-vinylcarbazole, poly-N-vinylcarbazole halide, polyvinyl pyrene, polyvinylanthracene, polyvinylacridine, a pyrene-formaldehyde resin, an ethylcarbazole-formaldehyde resin, a triphenylmethane polymer and polysilane, and the like.

In embodiments, the charge transporting molecule is an aryl amine, for example such as described in U.S. Pat. No. 6,913,863 or U.S. Pat. No. 6,350,550, each of which is incorporated herein by reference in its entirety. Examples of suitable aryl amines include triphenylmethane, bis(4-diethylamine-2-methylphenyl)phenylmethane, 4'-4"-bis(diethylamino)-2',2"-dimethyltriphenylmethane, N,N'-bis(alkylphenyl)-{1,1'-biphenyl}-4,4'-diamine wherein the alkyl is, for example, methyl, ethyl, propyl, butyl, hexyl, etc., N,N'-diphenyl-N,N'-bis(alkylphenyl)-1,1-biphenyl-4,4'-diamine wherein alkyl is selected from the group consisting of methyl, ethyl, propyl, butyl, hexyl, and the like, N,N'-diphenyl-N,N'-bis(halophenyl)-1,1'-biphenyl-4,4'-diamine wherein the halo substituent is, in embodiments, a chloro substituent, and N,N'-diphenyl-N,N'-bis(3"-methylphenyl)-(1,1'-biphenyl)-4,4'-diamine, combinations thereof and the like.

Any suitable polymer binder may be employed in the charge transport layer. Typical electrically inactive polymer binders include polycarbonate, polyester, polyarylate, polyacrylate, polyether, polysulfone, and the like. Molecular weights can vary, for example from about 20,000 to about 150,000. Exemplary binders include polycarbonates such as poly (4,4'-isopropylidene-diphenylene)carbonate (also referred to as bisphenol-A-polycarbonate); polycarbonate, poly (4,4'-cyclohexylidinediphenylene) carbonate (referred to as bisphenol-Z polycarbonate), poly (4,4'-isopropylidene-3,3'-dimethyl-diphenyl)carbonate (also referred to as bisphenol-C-polycarbonate), and the like.

Any suitable technique may be utilized to mix and thereafter apply the charge transport layer coating mixture. Typical application techniques include spraying, dip coating, roll coating, wire wound rod coating, and the like. Drying of the deposited coating may be effected by any suitable technique such as oven drying, infrared radiation drying, air drying and the like.

Generally, the thickness of the charge transport layer is from about 10 μm to about 100 μm, but a thickness outside this range can also be used. A ratio of the thickness of the charge transport layer to the charge generating layer may be maintained at, for example, from about 2:1 to 200:1.

The imaging member may comprise, for example, a charge generating layer sandwiched between conductive surface and a charge transport layer or a charge transport layer sandwiched between a conductive surface and a charge generating layer.

Optionally, an overcoat layer may also be utilized to improve resistance to abrasion. The overcoat layer is known in the art and may comprise thermoplastic organic polymers or inorganic polymers that are electrically insulating or slightly semi-conductive. Overcoat layers may be continuous and commercially have a thickness of less than about 10 μm such as from about 0.01 μm to about 10 μm.

Additionally, adhesive layers can be provided, if necessary or desired, between any of the layers in the photoreceptors to ensure adhesion of any adjacent layers. Alternatively, or in addition, adhesive material can be incorporated into one or both of the respective layers to be adhered. Such optional adhesive layers may have a thickness of about 0.001 μm to about 0.2 μm. Such an adhesive layer can be applied, for example, by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent. Suitable adhesives include film-forming polymers, such as polyester, DuPont 49,000 (available from E. I. DuPont de Nemours & Co.), VITEL PE-100 (available from Goodyear Tire and Rubber Co.), polyvinyl butyral, polyvinyl pyrrolidone, polyurethane, polymethyl methacrylate, and the like.

Also included within the scope herein are methods of imaging and printing with the imaging member described herein. These methods generally involve the formation of an electrostatic latent image on the imaging member, followed by developing the image with a toner composition comprised, for example, of thermoplastic resin, and colorant, such as pigment, subsequently transferring the image to a suitable image receiving substrate, and permanently affixing the image thereto. In those environments wherein the device is to be used in a printing mode, the imaging method involves the same aforementioned sequence with the exception that the exposure step can be accomplished with a laser device or image bar.

Processes of imaging, especially xerographic imaging and printing, including digital, are also encompassed. More specifically, the layered photoconductive imaging members can be selected for a number of different known imaging and printing processes including, for example, electrophotographic imaging processes, especially xerographic imaging and printing processes wherein charged latent images are rendered visible with toner compositions of an appropriate charge polarity. The imaging members are in embodiments sensitive in the wavelength region of, for example, from about 500 to about 900 nanometers, and thus gas and diode lasers, light emitting diodes (LED), and broad-band light sources such as tungsten, fluorescent, and xenon lamps can be selected as the light source. Moreover, the imaging members are useful in color xerographic applications, particularly high-speed color copying and printing processes. The imaging member may be utilized in a printer, copier, fax machine, etc.

In an image forming apparatus including the imaging member, the apparatus may include at least one charging station where an imaging member is charged, at least one exposing station where a latent image is formed in the imaging member through use of an appropriate radiation source such as light, at least one developing station where the latent image is developed, for example with a toner, on the imaging member surface, and a transfer station where the image is transferred to an image receiving substrate. A cleaning station for cleaning the imaging member surface after transfer of the image to an image receiving substrate such as paper may also be included. In the apparatus, the imaging member is made to associate with each station in forming the image, for example by rotating past each station if the imaging member is in belt or drum form.

The following Examples illustrate embodiments described above.

EXAMPLES 1-2 AND COMPARATIVE EXAMPLE 1

The rheology of a charge generating composition in accordance with embodiments described herein is compared to the rheology of a charge generating composition without any oxidized polyolefin.

In Example 1, a composition is prepared by Attritor milling 60% by weight of hydroxy gallium phthalocyanine (Type V) pigment in 40% by weight VMCH (Union Carbide) in tetrahydrofuran as the solvent, and adding thereto DISPARLON 4200-10 (Kusumoto Chemicals) as the oxidized polyolefin such that the composition includes 10% by weight of the oxidized polyolefin. The final solids percentage of the composition is 8%. The composition exhibits shear thinning rheology, with a viscosity of 16.5 cps at a shear rate of 0.2/sec and a viscosity of 2.7 cps at a shear rate of 100/sec.

In Example 2, a composition is prepared by Attritor milling 60% by weight of hydroxy gallium phthalocyanine (Type V) pigment in 40% by weight VMCH (Union Carbide) in tetrahydrofuran as the solvent, and adding thereto DISPARLON 4200-10 (Kusumoto Chemicals) as the oxidized polyolefin such that the composition includes 20% by weight of the oxidized polyolefin. The final solids percentage of the composition is 8%. The composition exhibits shear thinning rheology, with a viscosity of 117 cps at a shear rate of 0.05/sec and a viscosity of 3.1 cps at a shear rate of 100/sec.

In Comparative Example 1, a composition is prepared by Attritor milling 60% by weight of hydroxy gallium phthalocyanine (Type V) pigment in 40% by weight VMCH (Union carbide) in tetrahydrofuran as the solvent. The final solids percentage of the composition is 8%. The composition did not exhibit shear thinning rheology, the viscosity staying substantially the same regardless of the shear rate applied.

Each of the above Example and Comparative Example compositions is also evaluated for the extent of aggregation of the pigments therein by measuring RSI values (absorbance at 1000 nm/absorbance at maximum peak*100) using a UV-VIS spectrometer to derive the absorbance curve. The RSI value changes from 8.2 (no oxidized polyolefin in Comparative Example 1) to 9.1 (10% by weight oxidized polyethylene in Example 1) to 9.7 (20% by weight oxidized polyethylene in Example 2). The smaller the RSI value, the smaller the particle size. The RSI values thus indicate that very little pigment aggregation occurs through incorporation of the oxidized polyolefin into the composition.

Three photoreceptor devices are prepared with the following structures: a three-component undercoat layer, the above charge generating layer (Example 1 in device 1, Example 2 in device 2 and Comparative Example 1 in device 3), and a charge transport layer. The three-component undercoat layer is prepared as follows: zirconium acetylacetonate tributoxide (35.5 parts), γ-aminopropyltriethoxysilane (4.8 parts) and poly(vinyl butyral) BM-S (2.5 parts) are dissolved in n-butanol (52.2 parts). The coating solution is coated via a ring coater, and the layer is pre-heated at 59° C. for 13 minutes, humidified at 58° C. (dew point=54° C.) for 17 minutes, and dried at 135° C. for 8 minutes. The thickness of the undercoat layer is approximately 1.3 μm. The charge generating layer, at a thickness of 0.5 microns, is subsequently coated on top of the undercoat layer. Subsequently, a 25 μm thick charge transport layer (CTL) is coated on top of the charge generating layer from a solution prepared from N,N'-diphenyl-N,N-bis(3-methylphenyl)-1,1'-biphenyl-4,4'-diamine (5 grams) and a film forming polymer binder PCZ-400 (poly(4,4'-dihydroxy-diphenyl-1-1-cyclohexane, $M_w$=40,000)) available from Mitsubishi Gas Chemical Company, Ltd. (7.5 grams) dissolved in a solvent mixture of 20 grams of tetrahydrofuran (THF) and 6.7 grams of toluene. The CTL is dried at 120° C. for 40 minutes to provide the photoreceptor.

The above prepared photoreceptor devices are tested in a scanner set to obtain photo induced discharge curves, sequenced at one charge-erase cycle followed by one charge-expose-erase cycle, wherein the light intensity is incrementally increased with cycling to produce a series of photo induced discharge characteristic curves (PIDC) from which the photosensitivity and surface potentials at various exposure intensities are measured. Additional electrical characteristics are obtained by a series of charge-erase cycles with incrementing surface potential to generate several voltages versus charge density curves. The scanner is equipped with a scorotron set to a constant voltage charging at various surface potentials. The devices are tested at surface potentials of about 500 and about 700 volts with the exposure light intensity incrementally increased by means of regulating a series of neutral density filters; the exposure light source is a 780-nanometer light emitting diode. An aluminum drum is rotated at a speed of about 61 revolutions per minute to produce a surface speed of about 122 millimeters per second. The xerographic simulation is completed in an environmentally controlled light tight chamber at ambient conditions (about 50 percent relative humidity and about 22° C.). Very similar PIDC curves were obtained for all three devices. The incorporation of oxidized polyolefin into the charge generating layer thus does not adversely affect electrical characteristics of the photoreceptor device.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A composition comprising at least one charge generating material, at least one polymer binder and at least one oxidized polyolefin polymer or copolymer, wherein the oxidized polyolefin polymer or copolymer is selected from the group consisting of polyethylene homopolymer or copolymer composed of from about 60 mol % to about 100 mol % of the polymer of the ethylene units and polypropylene homopolymer or copolymer composed of from about 60 mol % to about 100 mol % of the polymer of propylene units.

2. The composition according to claim 1, wherein the at least one charge generating material is selected from the group consisting of metal free phthalocyanines, metal phthalocyanines, perylenes, bisazos, perinones, quinacridones, anthanthrones, pyranthrones, indogoides, polycyclic quinones, selenium and selenium alloys, azo pigments, squaraines, and mixtures thereof.

3. The composition according to claim 1, wherein the at least one charge generating material includes a metal phthalocyanine.

4. The composition according to claim 1, wherein the at least one polymer binder comprises polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinyl chlorides, polyvinyl alcohols, poly-N-vinylpyrrolidinones, vinyl chloride and vinyl acetate copolymers, acrylate copolymers, alkyd resins, cellulosic film formers, polyamideimides, styrene-butadiene copolymers, vinylidene chloride-vinyl chloride copolymers, vinyl acetate-vinylidene chloride copolymers, vinyl chloride-vinyl acetate-maleic acid copolymers, styrene-alkyd resins, polyvinyl carbazoles, or mixtures thereof.

5. The composition according to claim 1, wherein the at least one polymer binder includes a vinyl chloride-vinyl acetate-maleic acid copolymer.

6. The composition according to claim 1, wherein the at least one oxidized polyolefin has a weight average molecular weight of from about 1,000 to about 1,000,000.

7. The composition according to claim 1, wherein the at least one oxidized polyolefin has an acid number of from about 0.1 to about 1,000 mg KOH/g.

8. The composition according to claim 1, wherein the at least one oxidized polyolefin comprises from about 0.1% to about 30% by weight of the composition on a solids basis.

9. The composition according to claim 1, wherein the composition includes from about 25% to about 80% by weight of the at least one charge generating material dispersed in about 20% to about 75% by weight of the at least one binder.

10. An imaging member including a charge generating section therein, wherein the charge generating section comprises at least one charge generating material, at least one polymer binder and at least one oxidized polyolefin polymer or copolymer, wherein the oxidized polyolefin polymer or copolymer is selected from the group consisting of polyethylene homopolymer or copolymer composed of from about 60 mol % to about 100 mol % of the polymer of the ethylene units and polypropylene homopolymer or copolymer composed of from about 60 mol % to about 100 mol % of the polymer of propylene units.

11. The imaging member according to claim 10, wherein the at least one charge generating material is selected from the group consisting of metal free phthalocyanines, metal phthalocyanines, perylenes, bisazos, perinones, quinacridones, anthanthrones, pyranthrones, indogoides, polycyclic quinones, selenium and selenium alloys, azo pigments, squaraines, and mixtures thereof.

12. The imaging member according to claim 10, wherein the at least one polymer binder comprises polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinyl chlorides, polyvinyl alcohols, poly-N-vinylpyrrolidinones, vinyl chloride and vinyl acetate copolymers, acrylate copolymers, alkyd resins, cellulosic film formers, poly(amideimide)s, styrene-butadiene copolymers, vinylidene chloride-vinyl chloride copolymers, vinyl acetate-vinylidene chloride copolymers, vinyl chloride-vinyl acetate-maleic acid copolymers, styrene-alkyd resins, polyvinyl carbazoles, or mixtures thereof.

13. The imaging member according to claim 10, wherein the at least one oxidized polyolefin has a weight average molecular weight of from about 1,000 to about 1,000,000.

14. The imaging member according to claim 10, wherein the at least one oxidized polyolefin comprises from about 0.1% to about 30% by weight of the charge generating section on a solid basis.

15. The imaging member according to claim 10, wherein the charge generating section includes from about 25% to about 80% by weight of the at least one charge generating material dispersed in about 20% to about 75% by weight of the at least one binder.

16. The imaging member according to claim 10, wherein the charge generating section has a thickness of from about 0.05 μm to about 30 μm.

17. An imaging member comprising:

a substrate;

a charge generating layer; and a charge transport layer;

wherein the charge generating layer comprises at least one charge generating material, at least one polymer binder and at least one oxidized polyolefin polymer or copolymer wherein the oxidized polyolefin polymer or copolymer is selected from the group consisting of polyethylene homopolymer or copolymer composed of from about 60 mol % to about 100 mol % of the polymer of the ethylene umts and polypropylene homopolymer or copolymer composed of from about 60 mol % to about 100 mol % of the polymer of propylene units.

18. The imaging member according to claim 17, wherein the charge generating layer has a thickness of from about 0.05 μm to about 30 μm.

19. An image forming apparatus comprising:

at least one charging station, at least one exposing station, at least one developing station, a transfer station, and the imaging member according to claim 10, wherein the imaging member is capable of associating with each station in forming an image.

* * * * *